US005668693A

United States Patent [19]

Tennies et al.

[11] Patent Number: 5,668,693

[45] Date of Patent: Sep. 16, 1997

[54] METHOD OF MONITORING A CONTACTOR

[75] Inventors: Charles J. Tennies, Waukesha; Jerome K. Hastings; Matthew E. Hastings, both of Sussex, all of Wis.

[73] Assignee: Eaton Corporation, Cleveland, Ohio

[21] Appl. No.: 670,085

[22] Filed: Jun. 25, 1996

[51] Int. Cl.[6] ..... H01H 47/28

[52] U.S. Cl. ..... 361/187; 361/159; 361/154; 361/153

[58] Field of Search ..... 361/143, 159, 361/152–154, 173, 182, 186–187, 209, 170

[56] References Cited

U.S. PATENT DOCUMENTS

| | | | |
|---|---|---|---|
| 4,833,565 | 5/1989 | Bauer et al. | 361/154 |
| 4,905,121 | 2/1990 | Uetsuhara et al. | 361/159 |
| 5,053,911 | 10/1991 | Kopec et al. | 361/154 |
| 5,270,900 | 12/1993 | Alden et al. | 361/153 |
| 5,442,515 | 8/1995 | Wallaert | 361/187 |
| 5,486,972 | 1/1996 | Taylor | 361/154 |
| 5,539,608 | 7/1996 | Hurley et al. | 361/152 |

*Primary Examiner*—Jeffrey A. Gaffin
*Assistant Examiner*—Michael J. Sherry
*Attorney, Agent, or Firm*—Tarolli, Sundheim, Covell, Tummino & Szabo

[57] ABSTRACT

A varying voltage is applied across a coil of a contactor. The varying voltage has a characteristic (frequency) which varies as a function of the position of the armature. The varying voltage is transmitted to a coupler which transmits information to a controller. The coupler may include one or more light sources (LEDs) which are sequentially energized and de-energized to sequentially render a phototransistor conducting and nonconducting. The frequency of the output from the coupler corresponds to the frequency at which the phototransistor is changed between the conducting and nonconducting conditions. A controller determines whether the frequency of the output from the coupler corresponds to the intended position of the armature of the contactor or to an unintended position by comparing the frequency of the output from the coupler to known frequencies for various positions of the armature.

40 Claims, 3 Drawing Sheets

METHOD OF MONITORING A CONTACTOR

BACKGROUND OF THE INVENTION

The present invention relates to a method of monitoring the operation of a contactor and more specifically to a method of determining the position of an armature of a contactor relative to a stator of the contactor.

The position of an armature of a known contactor relative to a stator of the contactor has previously been determined by sensing changes in the inductance of the coil of the contactor. As the armature of the known contactor is moving toward a closed or actuated position, a plurality of current peaks are established in the coil of the contactor. The decay time of at least some of the current peaks is sensed. When the decay time exceeds the decay time of one or more previously measured current peaks by a selected amount, an inference is made that the inductance of the coil of the known contactor has changed sufficiently to indicate that the contactor has been operated to the actuated condition. A contactor control system which operates in this manner is disclosed in U.S. Pat. No. 5,053,911. Another known contactor control system is disclosed in U.S. Pat. No. 4,833,565.

SUMMARY OF THE INVENTION

The present invention relates to a new and improved method of monitoring the operation of a contactor. When the position of an armature of the contactor relative to a stator of the contactor is to be determined, a voltage of short duration is applied across a coil of the contactor. The position of the armature of the contactor relative to the stator of the contactor is determined by monitoring a characteristic of voltage across the coil of the contactor.

The voltage across the coil of the contactor is varied under the influence of stored energy. The stored energy may result in generation of a varying voltage at the coil of the contactor. The position of the armature of the contactor is determined by comparing a characteristic of the varying voltage to a reference containing information corresponding to positions of the armature. Information concerning the characteristics of the varying voltage may be transmitted to a controller by a coupler which contains a light source which is energized and de-energized as a function of variations in the voltage.

BRIEF DESCRIPTION OF THE DRAWINGS

The foregoing and other features of the invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
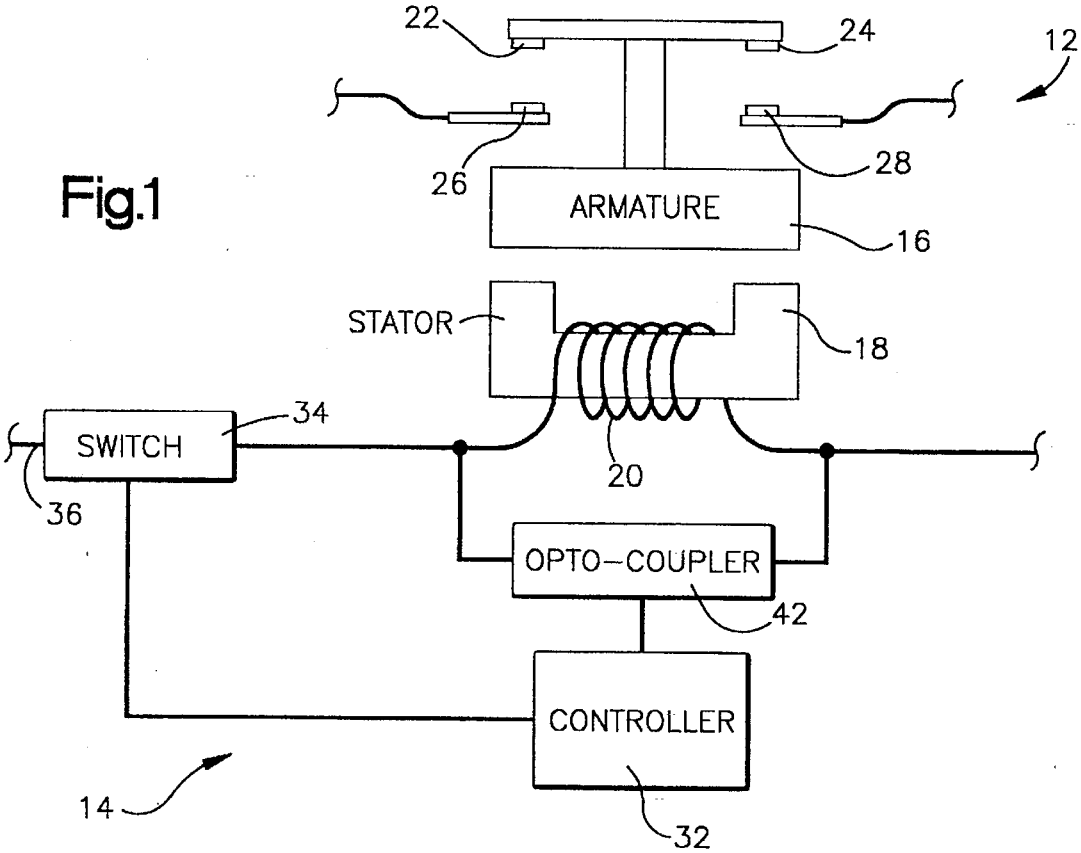
FIG. 1 is a schematic illustration of a contactor and a contactor control system which is operated in accordance with the present invention.

A contactor 12 is illustrated in FIG. 1 in association with control circuitry 14. The control circuitry 14 is utilized to effect operation of the contactor 12 between an actuated or closed condition and an unactuated or open condition. In addition, the control circuitry 14 is utilized to determine the position of an armature 16 relative to a stator 18 of the contactor 12.

The contactor 12 includes a coil 20 which extends around a portion of the stator 18 (FIG. 1). The armature 16 is urged away from the stator 18 by a suitable biasing spring (not shown). Upon energization of the coil 20 by the controls 14, a magnetic field is established to attract the armature 16 to the stator 18 in a known manner.

Movable contacts 22 and 24 are connected to the armature 16 and move with the armature relative to the stator 18. When the armature 16 is in the illustrated unactuated or fully open position, the movable contacts 22 and 24 are spaced from fixed contacts 26 and 28. As the contactor 12 is operated from the illustrated unactuated condition to the actuated condition, the armature 16 is moved downward (as viewed in FIG. 1) toward the stator 18 through intermediate positions to an actuated or fully closed position.

As the armature 16 moves toward the stator 18, the movable contacts 22 and 24 move into engagement with the fixed contacts 26 and 28. Shortly after this occurs, the armature 16 moves into engagement with the stator 18. When the armature 16 is disposed in engagement with or is closely adjacent to the stator 18, the contactor 12 is in the actuated condition and the armature 16 is in the actuated or fully closed position.

It is contemplated that the contactor 12 may have any one of many different known constructions. However, it is believed that it may be preferred to have the contactor 12 constructed in the manner disclosed in U.S. Pat. No. 4,760,364.

The inductance of the contactor coil 20 is a function of the position of the armature 16 relative to the stator 18. When the armature 16 is in the open or unactuated position, it is spaced relatively far from the stator 18. Therefore, the inductance of the coil 20 is relatively low. When the armature 16 is in the closed or actuated position, it is relatively close to the stator 18. Therefore, the inductance of the coil 20 is relatively high.

The frequency of a ringing voltage across the coil 20 varies as a function of variations in the inductance of the coil. Therefore, the frequency of the ringing voltage across the coil 20 varies as a function of the position of the armature 16 relative to the coil 18. The controls 14 sense the frequency of the ringing voltage to determine the position of the armature 16.

The controls 14 include a microprocessor or controller 32. The controller 32 is connected with a solid state switch 34 disposed in a line 36 which is connected with a source 38 (FIG. 2) of alternating current. A coupler 42 (FIG. 1) transmits information which corresponds to the position of the armature 16 relative to the stator 18 to the controller 32. The controller 32 utilizes this information to determine whether or not the armature 16 is in the desired position relative to the stator 18.

In the illustrated embodiment of the invention, the solid state switch 34 is a triac (FIG. 2) which is connected with the controller 32. When the triac forming the solid state switch 34 is to be rendered conducting or closed, a signal is transmitted from the controller 32 over a line 46 to the triac. The signal conducted over the line 46 to the triac renders the solid state switch 34 conducting so that current can flow from the alternating current source 38 through the coil 20 in the contactor 12 to energize the coil. Of course, a solid state switch other than a triac could be utilized to control the flow of current to the coil 20.

Figure 2:
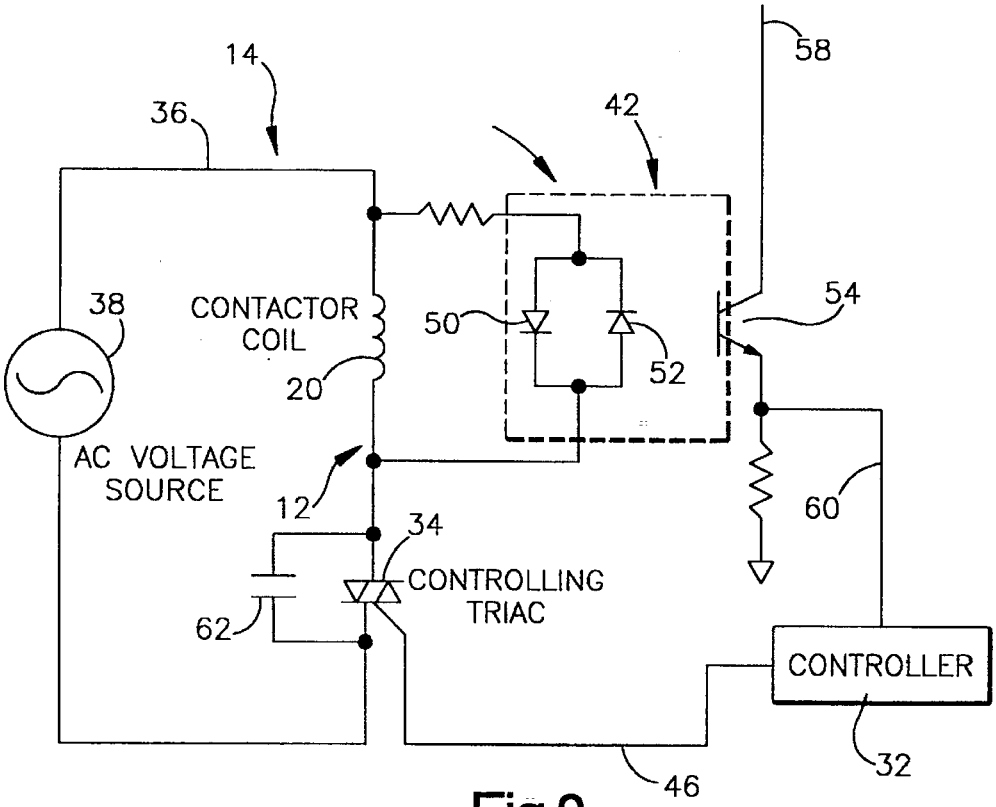
FIG. 2 is a schematicized illustration of the contactor and contactor control system of FIG. 1.

It is contemplated that many different types of couplers 42 could be utilized to transmit information concerning the position of the armature 16 relative to the stator 18 (FIG. 1) to the controller 32. However, the specific coupler illustrated in FIG. 2 is of the optical type and includes a pair of light sources 50 and 52 which are activated to render a phototransistor 54 conducting. In the illustrated embodiment of the coupler 42, the light sources 50 and 52 are light emitting diodes which are connected in parallel and conduct in opposite directions. If desired, only a single light emitting diode could be utilized.

The phototransistor 54 is connected to the power supply for the controller 32 through a lead 58. The phototransistor 54 is connected with the controller 32 through a lead 60. The phototransistor 54 and controller 32 cooperate to monitor the pulses of light from the light sources 50 and 52.

A capacitor 62 is connected in parallel with the triac 34. The capacitor 62 is connected in series with the coil 20 and light sources 50 and 52. The capacitor 62 acts as a suppressor to protect the triac 34. The capacitor 62 cooperates with the coil 20 to form an oscillator. The capacitor 62 is sized so that very little current from the alternating current source 38 is conducted through the capacitor.

Operation

When the contactor 12 is to be operated from the unactuated condition shown in FIG. 1 to the actuated condition, the controller 32 effects operation of the solid state switch 34 from an open or nonconducting condition to a closed or conducting condition. Current then flows from the alternating current source 38 through the coil 20. Energization of the coil 20 results in the establishment of a magnetic field which attracts the armature 16 against the influence of the associated biasing spring.

The magnetic field from the coil 20 moves the armature 16 from its fully open or unactuated position (FIG. 1) through intermediate positions to a fully closed or actuated position. As this occurs, the movable contacts 22 and 24 are moved into engagement with the fixed contacts 26 and 28.

The contactor 12 is subsequently operated from the actuated condition back to the unactuated condition. When this is to occur, the controller 32 effects operation of the solid state switch 34 to the nonconducting or open condition. The flow of current from the alternating current source 38 is interrupted and the coil 20 is de-energized. When this occurs, the armature 16 (FIG. 1) is moved away from the stator 18 under the influence of the biasing spring. As the armature 16 moves away from the stator 18, the movable contacts 22 and 24 are moved out of engagement with the fixed contacts 26 and 28.

When the coil 20 is de-energized and the contactor 12 is operated from the actuated condition to the unactuated condition, it is possible that, for some unforeseen reason, the armature 16 may not move from its actuated or fully closed position back to its unactuated or fully open position. Thus, a malfunction, such as sticking or contact welding may occur which results in the armature 16 remaining in engagement with the stator 18 (FIG. 1). Alternatively, the armature 16 could hang up in an intermediate position between the actuated position and the unactuated position.

In accordance with a feature of the invention, the control circuitry 14 is effective to transmit data to the controller 32 indicative of the position of the armature 16 relative to the stator 18 of the contactor 12. The information concerning the position of the armature 16 relative to the stator 18 of the contactor 12 is transmitted to the controller 32 by the coupler 42.

After the solid state switch 34 has been rendered nonconducting and the coil 20 de-energized, the contactor 12 operates from its actuated condition to its unactuated condition. To enable the coupler 42 to transmit to the controller 32 data indicative of the position of the armature 16 relative to the stator 18, an oscillating ringing voltage is established across the coil 20. The oscillating ringing voltage has a frequency which varies as a function of the position of the armature 16 relative to the stator 18. The oscillating ringing voltage effects sequential energization of the light sources 50 and 52 with a frequency which varies as a direct function of variations in the frequency of the ringing voltage. This results in the phototransistor 54 being pulsed between the conducting and nonconducting conditions with a frequency which is a function of the position of the armature 16 relative to the stator 18.

The varying ringing voltage energizes one of the light sources 50 or 52 whenever the voltage exceeds a predetermined positive voltage or a predetermined negative voltage. When the predetermined positive voltage, corresponding to the threshold level of the light source 50, is exceeded, the light source 50 emits light. When the predetermined negative voltage, corresponding to the threshold level of the light source 52 is exceeded, the light source 52 emits light.

To effect the establishment of the ringing voltage, the solid state switch 34 is operated from the nonconducting condition to the conducting condition for a very short period of time. This results in the transmission of a voltage impulse from the alternating current source 38 to the coil 20. A current of short duration is established in the coil 20.

In one specific embodiment of the controls 14, the controller 32 operated the solid state switch 34 to the conducting condition for a period of time which is equal to two degrees in a half cycle of the alternating current voltage source 38. The triac 34 then commutates to the nonconducting condition. Of course, the solid state switch 34 could be rendered conducting for a different period of time if desired so long as the conduction angle is small enough to prevent unintended actuation of the contactor.

The solid state switch 34 is rendered conducting and immediately thereafter is rendered nonconducting. The impulse of voltage applied to the contactor coil 20 during this relatively short period of time is ineffective to cause the armature 16 to move relative to the stator 18 of the contactor. Thus, when the solid state switch 34 is rendered conducting by the controller 32, there is only a brief pulse of current through the coil 20.

This pulse of current to the coil 20 is effective to establish a magnetic field. However, the magnetic field does not have a strength or duration sufficient to move the armature 16 relative to the stator 18. Therefore, the armature 16 remains in the same position it was in after the contactor 12 was operated to the unactuated condition. If the armature 16 is in the intended fully open or unactuated position, the armature remains in the unactuated position during the application of the brief impulse of voltage to the coil 20. Similarly, if a malfunction of the contactor 12 occurred and the armature 16 is hung up in a position other than its intended unactuated position, the armature remains in the unintended position.

The coil 20 and capacitor 62 are interconnected to form an LC oscillator. Thus, when the switch 34 is operated from the conducting condition to the nonconducting condition to terminate the brief pulse of current transmitted from the voltage source 38 through the coil 20, electrical energy stored in the capacitor 62 and magnetic field of the coil 20 causes an oscillating ringing current to flow between the capacitor and the coil.

The ringing current is conducted to and from the capacitor 62. As this occurs, a magnetic field is sequentially established and collapsed at the coil 20. The collapsing of a magnetic field at the coil 20 results in the generation of an induced voltage at the coil 20. This induced voltage causes electrical energy to be stored in the capacitor 62. The steps of establishing and then collapsing a magnetic field of diminishing strength at the coil 20 are repeated as the induced ringing voltage across the coil varies.

Whenever a positive ringing voltage pulse exceeds a minimum threshold voltage, the LED forming the light source 50 is rendered conducting. Whenever a negative ringing voltage pulse exceeds a predetermined negative threshold value, the LED 52 is rendered conducting. Therefore, the light sources 50 and 52 are energized at a rate which is a function of the frequency of the oscillating ringing voltage.

The frequency of the oscillating ringing voltage is a function of the inductance of the contactor coil 20. The inductance of the contactor coil 20 is a function of the position of the armature 16 relative to the stator 18. Therefore, the frequency with which the light sources 50 and 52 are energized is a function of the position of the armature 16 relative to the stator 18.

The phototransistor 54 is connected with the power supply for the controller 32 over the lead 58 and is connected with the controller 32 over the lead 60. The pulses of light emitted from the light sources 50 and 52, as a result of the oscillating ringing voltage, render the phototransistor 54 conducting. Therefore, the phototransistor 54 provides a direct current pulse train which has a frequency which is twice the frequency of the oscillating ringing voltage. This enables the controller 32 to monitor the frequency of the ringing voltage.

When the contactor 12 is in the unactuated condition and the armature is at the intended fully open position shown in FIG. 1, the armature is spaced a maximum distance from the stator 18. At this time, the coil 20 will have a relatively low inductance. Therefore, the frequency of the oscillating ringing voltage is relatively high.

Figure 3:
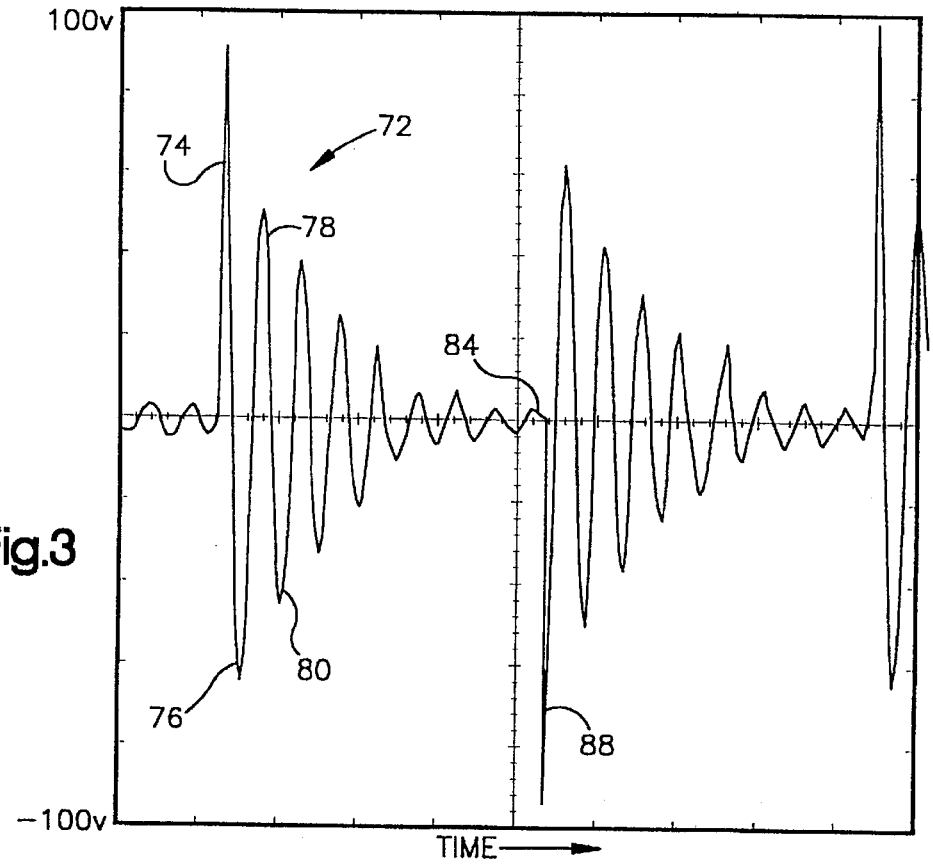
FIG. 3 is a schematic illustration depicting variations in a characteristic of a voltage across a coil of the contactor of when an armature of the contactor of FIG. 1 is in an open position.

The manner in which the oscillating ringing voltage varies with time when the armature 16 is in the fully open or unactuated position of FIG. 1 is illustrated by curve 72 in FIG. 3. An initial impulse of voltage which is applied to the coil 20 by rendering the solid state switch 34 conducting for a brief period of time is indicated at the peak 74 of the curve 72. A negative peak 76 of the curve 72 is a result of the electromotive force generated at the contactor coil 20 when the solid state switch 34 is rendered nonconducting and the magnetic field established in the coil collapses.

The negative peak 76 has an absolute value which is less than the value of the positive peak 74. This is due to the L/R decay constant of the circuit. Therefore, the next succeeding positive peak 78 has a value which is less than the preceding positive peak 74. Similarly, the next succeeding negative peak 80 has an absolute magnitude which is less than the absolute magnitude of the preceding negative peak 76.

The magnitude of the ringing voltage represented by of the peaks 74–80 is more than sufficient to exceed the threshold voltages of the light emitting diodes 50 and 52. Therefore, the light sources 50 and 52 are sequentially energized to pulse the phototransistor 54 with a frequency which is twice as great as the frequency of the oscillating ringing voltage curve 72. This results in a pulse train of positive direct current pulses being transmitted from the phototransistor 54 to the controller 32. This pulse train has a frequency which is twice as great as the frequency of the oscillating ringing voltage represented by the curve 72 of FIG. 3.

When a predetermined time has elapsed, the controller 32 (FIG. 2) again renders the solid state switch 34 conducting for a brief period of time. The resulting negative peak 88 has an absolute magnitude which corresponds to the absolute magnitude of the positive peak 74. Oscillating ringing voltage is conducted through the light source 50 and 52 and pulses the phototransistor 54 at the same rate as in which it was pulsed by the oscillating ringing voltage resulting from the positive peak 74.

The curve 72 illustrates the oscillating ringing voltage which is generated at the coil 20 when the armature 16 is in the intended, fully open, unactuated position. At this time, the armature 16 is spaced a maximum distance from the stator 18. Therefore, the frequency of the oscillating ringing voltage curve 72 is a maximum. For one specific contactor, the oscillating ringing voltage curve 72 had a frequency of 1,000 cycles per second (1 KHz). Of course, different contactors will have different frequencies.

In FIG. 3, the oscillating ringing voltage it offset in opposite directions from a zero voltage axis. It is contemplated that the oscillating ringing voltage could be offset from an axis disposed at a voltage level either greater than or less than zero.

It is contemplated that the contactor 12 may, for some unforeseen reason, malfunction so that the armature 16 does not move to its fully open or unactuated position when the contactor coil 20 is de-energized. An oscillating ringing voltage curve 92 (FIG. 4) illustrates the manner in which the frequency of the oscillating ringing voltage varies when the armature moves to an unintended intermediate position between the actuated or fully closed and unactuated or fully open positions.

Figure 4:
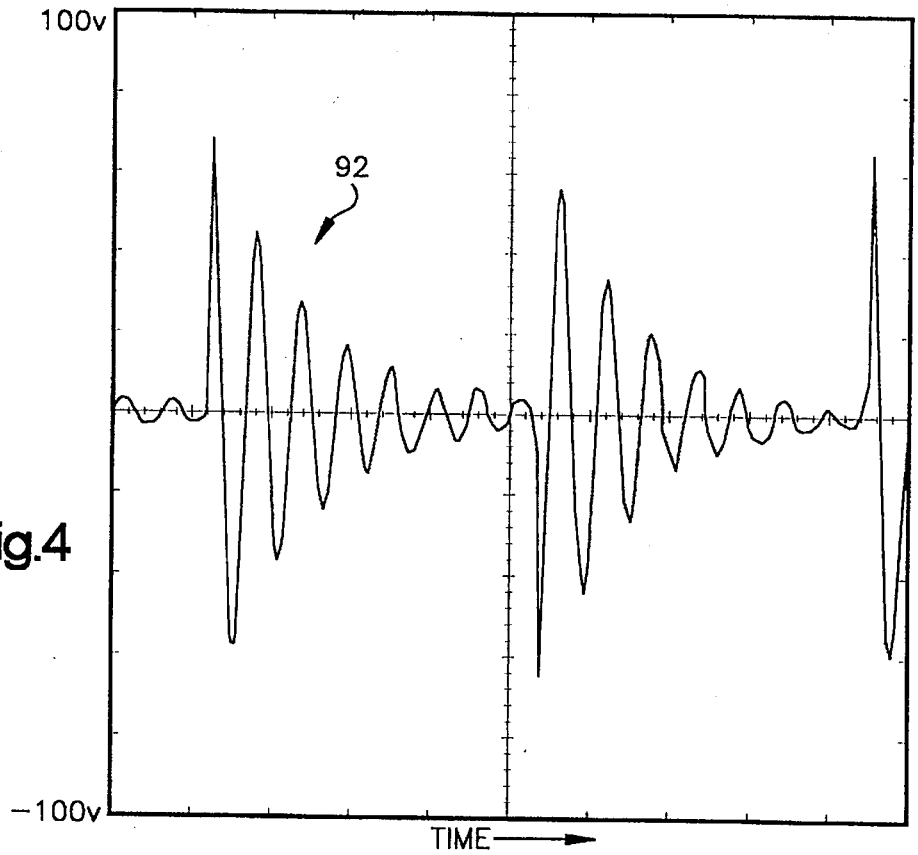
FIG. 4 is a schematic illustration depicting variations in the characteristic of a voltage across the coil of the contactor of FIG. 1 when the armature of the contactor is in a position between open and closed positions.

When the armature 16 is in the intermediate position corresponding to the oscillating ringing voltage curve 92 in FIG. 4, the movable contacts 22 and 24 are just barely engaging the fixed contacts 26 and 28. When the armature 16 is in the intermediate position it is closer to the stator 18 than when the armature is in the fully open or unactuated position. Therefore, the inductance of coil 20 is greater for the intermediate armature position corresponding to the curve 92 of FIG. 4 than for the fully open armature position corresponding to the curve 72 of FIG. 3. This results in the impedance of the circuit in which the oscillating ringing voltage of FIG. 4 is induced being greater than the impedance of the circuit in which the oscillating ringing voltage of FIG. 3 is induced.

The increased impedance of the ringing voltage circuit corresponding to FIG. 4 results in a decrease in the frequency of the oscillating ringing voltage. Thus, the frequency of the oscillating ringing voltage represented by the curve 92 of FIG. 4 is less than the frequency of the oscillating ringing voltage represented by the curve 72 of FIG. 3. For the specific embodiment of the contactor 12 previously referred to as having a frequency of 1,000 cycles per second when the armature 16 is in the fully open position, the oscillating ringing voltage curve 92 had a frequency of 862 cycles per second at contact touch. This results in the phototransistor 54 being pulsed at a lower rate.

It is contemplated that the contactor 12 may malfunction in such a manner that the armature 16 hangs up in the actuated or fully closed position upon de-energization of the coil 20 and operation of the contactor 12 to the unactuated condition. When this occurs, the inductance of the coil 20 is maximized. Therefore, the impedance of the circuit in which the induced voltage is generated at the contactor coil 20 is maximized.

Figure 5:
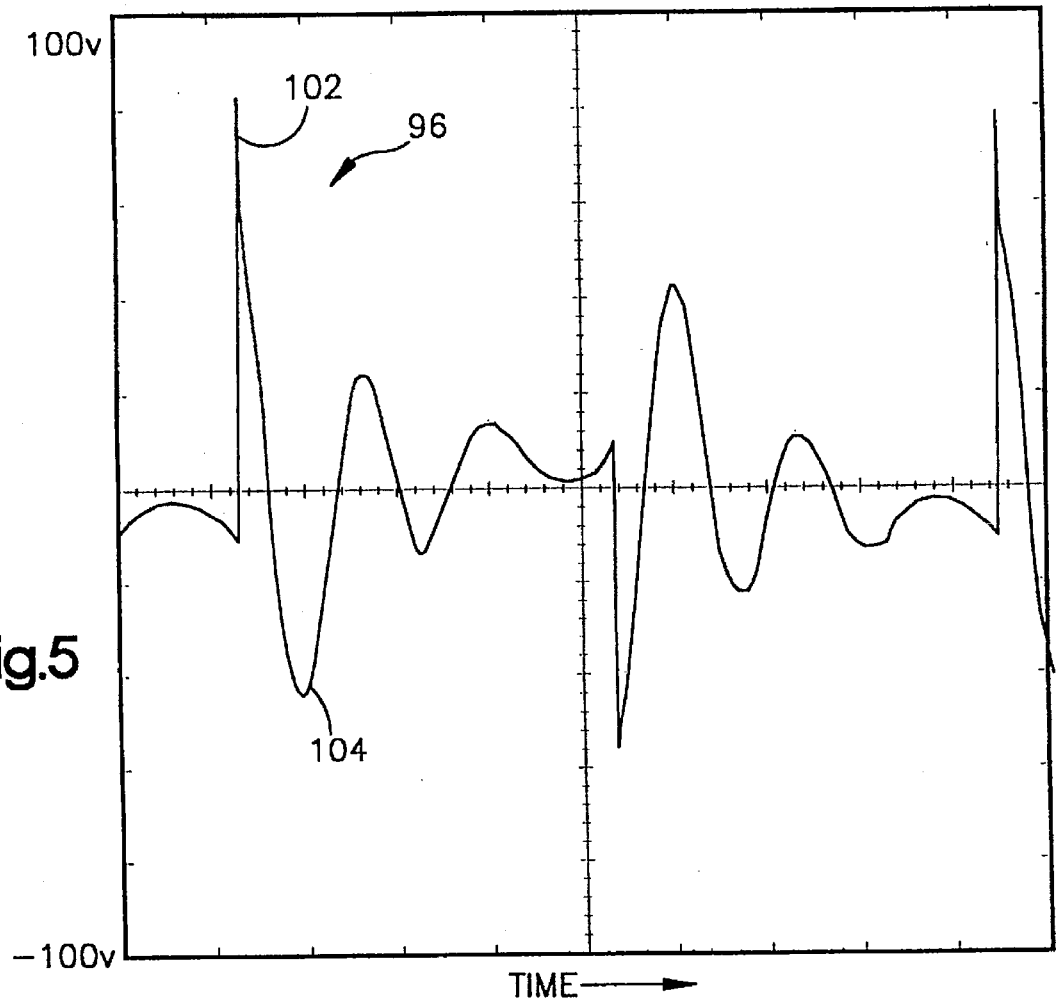
FIG. 5 is a schematic illustration depicting variations in the characteristic of a voltage across the coil of the contactor of FIG. 1 when the armature of the contactor of is in a closed position.

This results in the oscillating ringing voltage having a minimum frequency. The manner in which the oscillating ringing voltage varies when the armature 16 hangs up in the fully closed pongs up in the fully closed position is illustrated by the curve 96 in FIG. 5.

When the controller 32 briefly effects operation of the solid state switch 34 to a conducting condition, a voltage impulse 102 is applied to the contactor coil 20 from the alternating current source 38. As the magnetic field in the coil 20 collapses, negative voltage peak 104 is generated at the coil. The negative induced voltage peak 104 is effective to energize the light source 52 and again pulse the phototransistor 54. The previously mentioned specific embodiment of the contactor had an oscillating ringing voltage frequency of 347 cycles per second (347 Hz) when the armature 16 was in the fully closed position.

It should be understood that different contactors will generate oscillating ringing voltages of different frequencies at the contactor coil 20. The foregoing specific frequencies for the oscillating ringing voltage for various positions of the armature 16 for one specific embodiment of the contactor 12 have been set forth herein for purposes of clarity of description and not for purposes of limitation of the invention. Although it is preferred to impress the oscillating ringing voltage on the coil 20 when the contactor 12 is in the unactuated condition and the coil is de-energized, it is contemplated that the oscillating ringing voltage could be impressed on the coil 20 when the contactor is in the actuated condition and the coil 20 is energized.

The oscillating ringing voltage generated at the contactor coil 20 and conducted through the light sources 50 and 52 results in pulsing of the phototransistor 54 with a frequency which is twice the frequency of the oscillating ringing voltage. Therefore, the train of pulses conducted from the phototransistor 54 through the closed switch 64 to the controller 32 has twice the frequency as the oscillating ringing voltage. This enables the position of the armature 16 relative to the stator 18 to be determined by analyzing the frequency of the pulse train conducted from the phototransistor 54 to the controller 32 during the application of the oscillating ringing voltage generated at the contactor coil 20 to the light source 50 and 52.

In one specific embodiment of the invention, the controller 32 determines the frequency of the pulse train by measuring the length of time that the input signal from the phototransistor 54 was high before the next succeeding low was received. This is accomplished by counting the number of clock cycles that occur during the duration of the voltage pulse from the phototransistor 54. The duration of a plurality of the pulses from the phototransistor 54 are measured.

The durations of the pulses are then compared to predetermined values in a reference, such as a look-up table, in the controller 32. This enables the position of the armature 16 relative to the stator 18 to be determined. It should be understood that the low period between pulses or the length of time between positive edge portions of the pulses could be measured.

In another embodiment of the invention, the pulse train received from the phototransistor was monitored for a predetermined length of time by the controller 32. The controller had a sampling frequency at least twice as great as the highest frequency to be measured. The resulting pattern of lows and highs formed a digital word which is unique to a particular ringing frequency. The digital word is then compared to word values in a reference, such as a look-up table, in the controller 32. This enables the frequency of the oscillating ringing voltage to be determined.

In the specific embodiment of the invention illustrated in FIGS. 1–5, the coupler 42 is an optical coupler. It is believed that an optical coupler having a construction similar to the construction of the coupler 42 may be preferred to effect the transmission of data representative of the frequency of the oscillating ringing voltage to the controller 32. However, other known couplers could be utilized if desired. It is preferred to use the controls 14 to determine the frequency of the oscillating ringing voltage generated at the coil 20 when the contactor 12 is in the unactuated condition. However, a high frequency sine wave could be used to determine the position of the armature 16 when the coil 20 is energized.

Conclusion

The present invention relates to a new and improved method of monitoring the operation of a contactor 12. When the position of an armature 16 of the contactor 12 relative to a stator 18 of the contactor is to be determined, a voltage of short duration is applied across the coil 20 of the contactor. The position of the armature 16 of the contactor 12 relative to the stator 18 of the contactor is determined by monitoring a characteristic (frequency) of voltage across the coil 20 of the contactor.

The voltage across the coil 20 of the contactor 12 is varied under the influence of voltage generated at the coil 20 of the contactor 12. The position of the armature 16 of the contactor 12 is determined by comparing a characteristic (frequency) of the varying voltage to a reference containing information corresponding to positions of the armature 16. Information concerning the characteristics of the varying voltage may be transmitted to a controller 32 by a coupler 42 which contains a light source (50 or 52) which is energized and de-energized as a function of variations in the voltage.

Having described the invention, the following is claimed:

1. A method of monitoring operation of a contactor, said method comprising the steps of operating the contactor from an actuated condition to an unactuated condition by de-energizing a coil of the contactor, applying a voltage of short duration across the coil of the contactor while maintaining the contactor in the unactuated condition, and determining the position of an armature of the contactor relative to a stator of the contactor while the contactor is in the unactuated condition by monitoring a characteristic of voltage across the coil of the contactor.

2. A method as set forth in claim 1 wherein said step of monitoring a characteristic of voltage across the coil of the contactor includes monitoring the frequency of voltage across the coil of the contactor.

3. A method as set forth in claim 1 further including the step of operating a switch from a nonconducting condition to a conducting condition to energize the coil of the contactor and effect operation of the contactor from the unactuated condition to the actuated condition, said step of operating the contactor from the actuated condition to the unactuated condition includes operating the switch from the conducting condition to the nonconducting condition, said step of applying a voltage of short duration across the coil of the contactor includes operating the switch from the nonconducting condition to the conducting condition and immediately thereafter operating the switch from the conducting condition to the nonconducting condition.

4. A method as set forth in claim 3 wherein said step of monitoring a characteristic of voltage across the coil of the contactor is at least partially performed with the switch in the nonconducting condition after performance of said step of applying a voltage of short duration across the coil of the contactor.

5. A method as set forth in claim 1 wherein said step of monitoring a characteristic of voltage across the coil of the contactor is at least partially performed after performing said step of applying a voltage of short duration across the coil of the contactor.

6. A method as set forth in claim 1 wherein said step of applying a voltage of short duration across the coil of the contactor while maintaining the contactor in the unactuated condition includes operating a switch from a nonconducting condition to a conducting condition to apply a voltage to the coil and then operating the switch from the conducting condition to the nonconducting condition to interrupt the application of voltage to the coil, said step of monitoring a characteristic of voltage across the coil of the contactor being at least partially performed with the switch in the nonconducting condition.

7. A method as set forth in claim 1 wherein said step of monitoring a characteristic of voltage across the coil of the contactor includes determining the position of the armature of the contactor as a function of the frequency of the voltage across the coil after having performed said step of applying a voltage of short duration across the coil of the contactor while maintaining the contactor in the unactuated condition.

8. A method as set forth in claim 1 further including the step of varying voltage across the coil of the contactor under the influence of voltage generated at the coil of the contactor while the contactor is in the unactuated condition and after performance of said step of applying a voltage of short duration across the coil of the contactor while maintaining the contactor in the unactuated condition.

9. A method as set forth in claim 1 wherein said step of applying a voltage of short duration across the coil of the contactor while maintaining the contactor in the unactuated condition includes operating a switch from a nonconducting condition to a conducting condition to enable current to flow through the switch to the coil and then operating the switch from the conducting condition to the nonconducting condition, said method further including the step of thereafter varying the voltage across the coil of the contactor while maintaining the switch in the nonconducting condition, said step of monitoring a characteristic of voltage across the coil of the contactor includes monitoring a characteristic of the varying voltage.

10. A method as set forth in claim 1 wherein said step of monitoring a characteristic of the voltage across the coil of the contactor includes determining the duration of a voltage pulse.

11. A method as set forth in claim 1 wherein said step of monitoring a characteristic of the voltage across the coil of the contactor includes determining the duration of pulses in a series of pulses while the contactor is in the unactuated condition and comparing the duration of the pulses in the series of pulses with the known duration of pulses in a series of pulses for each position of a plurality of positions of the armature relative to the stator of the contactor.

12. A method as set forth in claim 1 wherein said step of monitoring a characteristic of voltage across the coil of the contactor includes sequentially energizing and de-energizing a light source under the influence of current conducted through the coil of the contactor while the contactor is in the unactuated condition to provide pulses of light of a duration which varies as a function of the characteristic of voltage across the coil of the contactor.

13. A method of controlling operation of a contactor, said method comprising the steps of operating the contactor between actuated and unactuated conditions by electrically energizing a coil of the contactor to move an armature of the contactor toward a stator of the contactor under the influence of a magnetic field from the coil to operate the contactor from the unactuated condition to the actuated condition and de-energizing the coil of the contactor to enable the armature of the contactor to move away from the stator of the contactor to operate the contactor from the actuated condition to the unactuated condition, varying a voltage across the coil of the contactor under the influence of energy which is stored when the contactor is in one of the actuated and unactuated conditions, and determining the position of the armature relative to the stator of the contactor as a function of a characteristic of the varying voltage.

14. A method as set forth in claim 13 wherein said step of determining the position of the armature relative to the stator of the contactor as a function of a characteristic of the varying voltage includes determining the duration of a voltage pulse.

15. A method as set forth in claim 13 wherein said step of determining the position of the armature relative to the stator of the contactor as a function of a characteristic of the varying voltage includes determining the duration of pulses in a series of pulses while the armature is stationary and comparing the duration of the pulses in the series of pulses with a known duration of pulses in a series of pulses for various positions of the armature relative to the stator of the contactor.

16. A method as set forth in claim 13 wherein said step of electrically energizing the coil of the contactor includes connecting the coil of the contactor with a source of alternating current, said step of conducting a varying voltage across the coil of the contactor being at least partially performed with the coil of the contactor disconnected from the source of alternating current.

17. A method as set forth in claim 13 wherein said step of varying a voltage across the coil of the contactor under the influence of energy which is stored includes changing magnetic flux through the coil and inducing electrical current to flow under the influence of the changing magnetic flux through the coil.

18. A method as set forth in claim 13 wherein said step of varying a voltage across the coil of the contactor under the influence of energy which is stored includes inducing a peak in varying voltage under the influence of a changing magnetic field at the coil of the contactor.

19. A method as set forth in claim 13 wherein said step of varying a voltage across the coil of the contactor under the influence of energy which is stored includes transmitting energy to the coil of contactor from a source of stored energy, and, thereafter, transmitting energy from the coil of the contactor to the source of stored energy.

20. A method as set forth in claim 19 wherein said step of increasing voltage transmitted to the coil of the contactor is initiated when armature is in one position relative to the stator of the contactor.

21. A method as set forth in claim 13 further including the step of energizing a light emitting diode under the influence of the varying voltage to provide pulses of light of a duration which is a function of the characteristic of the varying voltage, said step of determining the position of the armature relative to the stator of the contactor includes monitoring the pulses of light emitted by the light source under the influence of the varying voltage.

22. A method of controlling operation of a contactor, said method comprising the steps of operating the contactor between unactuated and actuated conditions by electrically energizing a coil of the contactor to move an armature of the contactor toward a stator of the contactor under the influence of a magnetic field from the coil to operate the contactor from the unactuated condition to the actuated condition and de-energizing the coil of the contactor to enable the armature of the contactor to move away from the stator of the contactor to operate the contactor from the actuated condition to the unactuated condition, said steps operating the contactor between the unactuated and actuated conditions include moving the armature of the contactor relative to the stator of the contactor from a fully open position through intermediate positions to a fully closed position, applying a voltage to the coil of the contactor while armature of the contactor is in one of the fully open, fully closed or intermediate positions, determining a characteristic of the voltage across the coil of the contactor while the armature of the contactor is in the one of the positions, providing a reference containing known characteristics of voltage across the coil when the armature of the coil is at each of the fully open, fully closed, and intermediate positions, and determining which one of the positions the armature is in by comparing the characteristic of the voltage across the coil of the contactor while the armature of the contactor is in the one position with the reference containing characteristics of voltage across the coil when the armature of the contactor is at the fully open, fully closed, and intermediate positions.

23. A method as set forth in claim 22 wherein said step of determining a characteristic of the voltage across the coil of the contactor includes sequentially energizing and de-energizing a light source under the influence of voltage across the coil of the contactor while the armature of the contactor is in the one position to provide pulses of light of a duration which varies as a function of the characteristic of the current conducted through the coil of the contactor.

24. A method as set forth in claim 22 wherein said step of applying a voltage across the coil of the contactor includes applying a varying voltage to the coil of the contactor under the influence of energy stored while the armature of the contactor is in the one position.

25. A method as set forth in claim 22 wherein said step of applying voltage across the coil of the contactor while the armature is in the one position includes applying a voltage of short duration to the coil of the contactor while the armature of the contactor is in the one position.

26. A method as set forth in claim 22 wherein said step of determining a characteristic of the voltage across the coil of the contactor while the armature of the contactor is in the one position includes determining the duration of pulses in a series of pulses, said step of comparing the characteristic of the voltage across the coil of the contactor while the armature of the contactor is in the one position with the reference includes comparing the duration of the pulses with known durations for pulses when the armature of the contactor is at the fully open, fully closed and intermediate positions.

27. A method as set forth in claim 22 wherein said step of determining a characteristic of the voltage across the coil of the contactor while the armature of the contactor is in the one position includes determining the frequency of the voltage across the coil of the contactor, said step of comparing the characteristic of the voltage across the coil of the contactor while the armature of the contactor is in the one position with the reference includes comparing the frequency of the voltage across the coil of the contactor while the armature is in the one position with known frequencies for voltages across the coil of the contactor when the armature of the contactor is at the fully open, fully closed and intermediate positions.

28. A method of controlling operation of a contactor, said method comprising the steps of operating the contactor between unactuated and actuated conditions by electrically energizing a coil of the contactor to move an armature of the contactor toward a stator of the contactor under the influence of a magnetic field from the coil to operate the contactor from the unactuated condition to the actuated condition and de-energizing the coil of the contactor to enable the armature of the contactor to move away from the stator of the contactor to operate the contactor from the actuated condition to the unactuated condition, said steps operating the contactor between the unactuated and actuated conditions include moving the armature of the contactor relative to the stator of the contactor from a fully open position through intermediate positions to a fully closed position, conducting a varying current through the coil of the contactor while armature of the contactor is in one of the fully open, fully closed or intermediate positions, and providing an output indicative of the one position of the armature by energizing and de-energizing a light source as a function of variations in a characteristic of the voltage across the coil of the contactor.

29. A method as set forth in claim 28 wherein said step of conducting a varying current through the coil of the contactor includes conducting current through the coil of the contactor under the influence of voltage generated at the coil of the contactor while the armature of the contactor is in the one position.

30. A method as set forth in claim 28 wherein said method further includes the step of conducting a current of short duration through the coil of the contactor while the armature of the contactor is in the one position and prior to performance of said step of conducting a varying current through the coil of the contactor.

31. A method as set forth in claim 28 wherein said step of energizing and de-energizing a light source as a function of variations in a characteristic of the voltage across the coil of the contactor includes conducting an oscillating current through the coil of the contactor and through the light source.

32. A method of controlling operation of a contactor, said method comprising the steps of operating the contactor between unactuated and actuated conditions by electrically energizing a coil of the contactor to move an armature of the contactor toward a stator of the contactor under the influence of a magnetic field from the coil to operate the contactor from the unactuated condition to the actuated condition and de-energizing the coil of the contactor to enable the armature of the contactor to move away from the stator of the contactor to operate the contactor from the actuated condition to the unactuated condition, generating a voltage at the coil of the contactor when the contactor is in one of the actuated and unactuated conditions, and determining the position of the armature relative to the stator of the contactor as a function of a characteristic of the generated voltage.

33. A method as set forth in claim 32 wherein said step of determining the position of the armature relative to the stator of the contactor as a function of a characteristic of the generated voltage includes determining the duration of a voltage pulse.

34. A method as set forth in claim 32 wherein said step of determining the position of the armature relative to the stator of the contactor as a function of a characteristic of the generated voltage includes determining the duration of pulses in a series of pulses while the armature remains in one position relative to the stator and comparing the duration of the pulses in the series of pulses with a known duration of pulses in a series of pulses for various positions of the armature relative to the stator of the contactor.

35. A method as set forth in claim 32 wherein said step of electrically energizing the coil of the contactor includes connecting the coil of the contactor with a source of alternating current, said step of generating a voltage at the coil of the contactor being at least partially performed with the coil of the contactor disconnected from the source of alternating current.

36. A method as set forth in claim 32 wherein said step of generating a voltage at the coil of the contactor includes changing the magnetic flux through the coil and inducing electrical current to flow under the influence of the changing magnetic flux through the coil.

37. A method as set forth in claim 32 wherein said step of generating voltage at the coil of the contactor includes inducing a peak in a varying voltage under the influence of a changing magnetic field at the coil of the contactor.

38. A method as set forth in claim 32 wherein said step of generating voltage at the coil of the contactor includes transmitting energy to the coil of the contactor from a source of stored energy, and, thereafter, transmitting energy from the coil of the contactor to the source of stored energy.

39. A method as set forth in claim 38 wherein said step of increasing voltage transmitted to the coil of the contactor is initiated when the armature is in one position relative to the stator of the contactor.

40. A method as set forth in claim 32 further including the step of energizing a light emitting diode under the influence of the generated voltage to provide pulses of light of a duration which is a function of the characteristic of the generated voltage, said step of determining the position of the armature relative to the stator of the contactor includes monitoring the pulses of light emitted by the light source under the influence of the generated voltage.

* * * * *